United States Patent [19]

Schaefer et al.

[11] 4,033,706

[45] July 5, 1977

[54] FLUID DELIVERY SYSTEM WITH A JET PUMP BOOSTER AND MEANS TO MAINTAIN A CONSTANT RATE OF FLOW THROUGH THE JET NOZZLE

[75] Inventors: John G. Schaefer; Terry L. Whitesel, both of Rockford, Ill.

[73] Assignee: Sundstrand Corporation, Rockford, Ill.

[22] Filed: Aug. 6, 1975

[21] Appl. No.: 602,240

[52] U.S. Cl. ..... 417/79; 417/186; 417/189

[51] Int. Cl.[2] ..... F04B 23/04; F04F 5/48

[58] Field of Search ..... 417/76, 186, 189, 79, 417/191; 137/501

[56] References Cited

UNITED STATES PATENTS

| | | | |
|---|---|---|---|
| 2,622,531 | 12/1952 | Brady | 417/186 |
| 2,665,704 | 1/1954 | Kanuch | 137/501 |
| 2,812,715 | 11/1957 | Redding et al. | 417/79 |
| 3,043,107 | 7/1962 | Magnus | 417/79 |
| 3,182,596 | 5/1965 | Prijatel | 417/309 |
| 3,532,441 | 10/1970 | Schofield | 417/203 |
| 3,551,073 | 12/1970 | Petrovits | 417/87 |

FOREIGN PATENTS OR APPLICATIONS

| | | | |
|---|---|---|---|
| 559,108 | 2/1944 | United Kingdom | 417/79 |

*Primary Examiner*—John J. Vrablik
*Assistant Examiner*—Thomas I. Ross
*Attorney, Agent, or Firm*—Wegner, Stellman, McCord, Wiles & Wood

[57] ABSTRACT

A fluid delivery system and, more particularly, a system for delivering fuel to an aircraft engine. A positive displacement pump delivers fuel to the engine and is supplied by an ejector boost pump connected to a fuel tank and having a nozzle supplied with fuel delivered by the fuel pump for drawing fuel from the tank and increasing the pressure of the fuel prior to delivery through interstage components to the inlet of the fuel pump. Valve means responsive to the pressure differential across the nozzle of the ejector boost pump operates to maintain a uniform rate of fuel flow through the nozzle. In certain embodiments of the fluid delivery system, the fuel pump is provided with auxiliary inlets for delivery of fuel to pumping chambers out of communication with the main inlet of the pump for improved operation of the fuel pump and avoidance of problems encountered from the presence of vapor in the fuel.

18 Claims, 6 Drawing Figures

FLUID DELIVERY SYSTEM WITH A JET PUMP BOOSTER AND MEANS TO MAINTAIN A CONSTANT RATE OF FLOW THROUGH THE JET NOZZLE

BACKGROUND OF THE INVENTION

This invention pertains to fluid delivery systems and, more particularly, a system for delivery of fuel from a tank to an aircraft engine.

A known fuel delivery system for an aircraft engine has a main engine fuel pump of the positive displacement type which delivers fuel to the engine and a tank-mounted power-driven fuel boost pump which supplies fuel to the positive displacement pump. Such a system has disadvantages in those instances where the tank-mounted fuel boost pump is electrically driven, since there can be a fire hazard resulting from a crash landing since the boost pump could continue to pump fuel in the emergency situation. In military applications, such as in helicopters, there can be a problem when small arms fire, for example, penetrates the fuel lines.

It is also recognized that the operational characteristics of the main engine fuel pump vary with different altitude operating conditions. The suction lift capability of a positive displacement pump for drawing fuel to the inlet of the pump (also referred to as net positive suction head) is variable. Performance also varies based upon the vapor-to-liquid ratio of the fuel, with there normally being an increase in vapor relative to liquid at the inlet to the main engine fuel pump as the result of increased altitude.

The use of auxiliary inlets in a positive displacement pump for assuring complete filling of successive pumping chambers to reduce problems encountered by the presence of vapor in the liquid fuel is shown in the Prijatel U.S. Pat. No. 3,182,596.

The use of a jet eductor to collect vapor from the lines of a liquid fuel system and dissolve vapor into the liquid is shown in the Schofield U.S. Pat. No. 3,532,441.

SUMMARY

A primary feature of the fluid delivery systems disclosed herein is to assure, at all operating altitudes of the engine, the delivery of liquid fuel without vapor at a given flow rate and at a given pressure to the engine. As the engine operates at increasing altitudes, there is an increase in vapor relative to liquid fuel because of reduced pressures and temperatures which releases entrained air and certain hydrocarbons from the fuel. The liquid fuel and vapor constitutes a two-state flow and with the invention disclosed herein, the two-state flow is passed through a boost stage ejector pump for drawing fuel from the tank and increasing the pressure thereof to render the fuel more nearly a single-state flow without vapor. Additionally, the positive displacement fuel pump supplied by the boost ejector pump can have auxiliary inlets for assuring more complete filling of the pumping chambers thereof to further reduce possible delivery of vapor to the engine.

Another feature of the invention is to have a system wherein the ejector boost pump operates to overcome interstage system losses between the boost pump and the main engine fuel pump derived by flow of fuel through items such as heat exchangers, filters, piping, cores and any other necessary parts of the system. The interstage losses will affect the inlet performance capability of the main engine fuel pump. In order to assure proper operation, a flow control valve is used in the system to provide a constant flow to the nozzle of the ejector boost pump, with said fuel being derived from the displacement of the main engine fuel pump. The total flow usable by the nozzle varies with engine fuel demands, but the flow control valve establishes a uniform rate of flow to the nozzle, even with varying engine fuel demands.

Another feature of the invention resides in the use of a maintained rate of fuel flow to the nozzle from the displacement of the main engine fuel pump at an optimum flow value for peak ejector boost pump efficiency and with this flow being normally of an amount less than that which is bypassed from a fuel control for the engine and with the remainder thereof being supplied to auxiliary inlets for the main engine fuel pump for assuring proper operation of the pump at all operating altitudes and without adverse effects from vapor in the fuel.

The fluid delivery systems disclosed herein provide cost and weight advantages for an aircraft by the elimination of the conventional fuel boost pump and, additionally, improves safety by reducing the fire hazard resulting from a crash landing. These advantages are derived from the use of an ejector boost pump which draws fuel from the tank and supplies it to the inlet of the main engine fuel pump and with the ejector boost pump having a nozzle supplied with fuel from the fuel pumped by the main engine fuel pump. There can be no operation of the ejector boost pump unless the main engine fuel pump is operating.

One of the objects of the invention is to provide a fluid delivery system having a positive displacement fuel pump for delivering fuel to a fuel control for an engine and a bypass line for returning a part of the fuel to the system, an ejector boost pump having an inlet connected to a fuel tank, and an outlet connected through interstage components to the inlet of the positive displacement pump, said nozzle being connected to the bypass line for delivery of fuel to the nozzle for flow therethrough, a priority valve connected in a branch line extended between the bypass line and auxiliary inlets for the positive displacement pump which communicate with pumping chambers thereof without communicating with said fuel pump inlet, and with the priority valve being responsive to a pressure differential across the nozzle whereby a constant rate of fuel flow is maintained to the nozzle with excess fuel flowing through the branch line and the priority valve to the auxiliary inlets. The aforesaid combination of a positive displacement pump with auxiliary inlets to assure proper operation even with vapor in the fuel along with the ejector boost pump and said priority valve, result in meeting the net positive suction head requirements of the fluid system and delivery of single-state fuel at a desired pressure and rate to the engine.

The fluid delivery system defined in the preceding paragraph utilizing uniform flow through the nozzle increases the number of ejector boost pump designs which can be considered in order to obtain the boost performance required to overcome the interstage system losses between the boost pump and the positive displacement pump. The interstage losses will affect the positive displacement pump's inlet performance capability. In addition to the boost stage, these losses are compensated for by the use of the auxiliary inlets to the positive displacement pump. At conditions where the ejector performance is low and/or interstage losses are high, the auxiliary inlet assist for the positive displacement pump extends the performance capability through the use of the priority valve which directs excess non-utilized flow to the auxiliary inlets. This system combination extends the number of applications for which an ejector design may be selected as a boost stage and permits optimization of the ejector boost structure. This is accomplished through the selection of an optimum flow value for peak ejector efficiency and, at the same time, provides for motive flow of fuel to the auxiliary inlets of the positive displacement pump through the use of the priority valve.

A further object of the invention is to extend the over-all system performance by combining the optimized ejector design of the boost stage with the performance advantages gained through the use of the auxiliary inlets to the positive displacement pump.

Other objects of the invention are to provide additional embodiments of the fluid delivery system wherein in a first modification thereof the branch line having the priority valve may deliver fuel from the bypass line directly to the inlet of the positive displacement pump without said pump having the auxiliary inlets. In other embodiments, a flow control valve is utilized, rather than a priority valve, and is connected in a line extending between the discharge line of the positive displacement pump and the nozzle and provides for a constant rate of fuel flow to the nozzle by being responsive to a pressure differential across the orifice of the nozzle and with the bypass line which extends from the fuel control being connected either to the inlet of the positive displacement pump or to auxiliary inlets, if provided, in the positive displacement pump.

DESCRIPTION OF THE PREFERRED EMBODIMENTS

Figure 1:
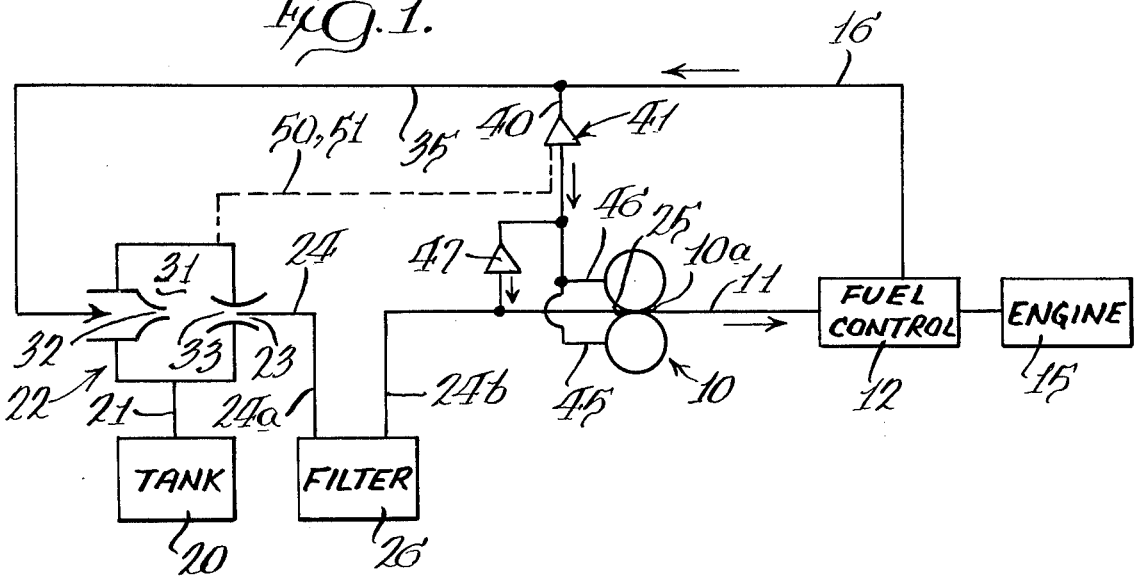
FIG. 1 is a schematic view of a first embodiment of the invention.

The first embodiment of the invention has a positive displacement pump, indicated generally at 10, with an outlet 10*a* connected to a discharge line 11, leading to a fuel control 12 for controlling the rate of fuel supply to a load, such as an aircraft engine 15. Fuel not delivered to the engine by the fuel control is directed to a bypass line 16 for return to the fluid delivery system.

The fuel supply for the engine is stored in a tank 20 which is connected by a line 21 to a boost stage, indicated generally at 22, which is in the form of an ejector boost pump having an outlet 23 connected to a line 24 which extends to an inlet 25 of the positive displacement pump, with line sections 24*a* and 24*b* extending, respectively, to and from an interstage system, indicated generally at 26, and which normally comprises heat exchangers, filters, as well as other components which are necessary parts of a fuel system.

Figure 2:
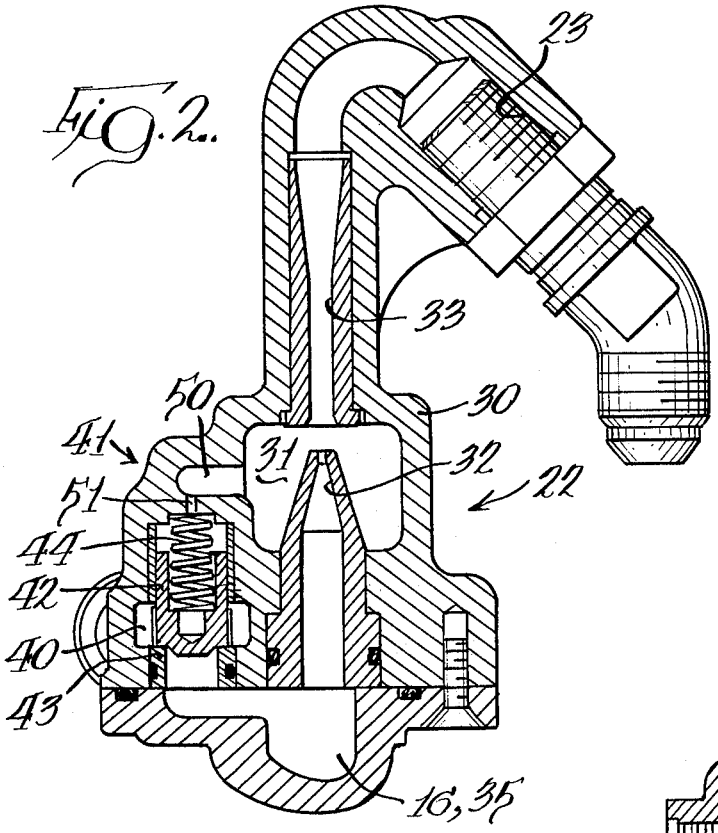
FIG. 2 is a fragmentary central section of a structural unit embodying the ejector boost pump and the priority valve shown in FIG. 1.

The boost stage ejector pump is shown particularly in FIG. 2 with a casing 30 having a plenum chamber 31 connected to the line 21 leading from tank 20 and a nozzle 32 defining an orifice opening into the plenum and with a mixing tube 33 downstream of the plenum and functioning to provide a momentum exchange in the fuel which flows through the nozzle of the boost stage and which flows into the plenum from the tank 20.

Fuel representing part of the fuel displacement of the main engine fuel pump 10 is caused to flow through the nozzle 32 by an extension 35 of the bypass line which extends to the inlet of the nozzle 32 as shown in FIG. 1.

The fuel entering the plenum from the tank 20 may be a two-state flow with both liquid and vapor phases. The ejector pump functions to increase the pressure of the fuel and return the vapor phase into the liquid phase and obtain a single-state flow for delivery to the main fuel pump 10.

A branch line 40 extends from bypass line 16 and has a motive flow source control valve positioned therein which, in the embodiment of FIG. 1, is a priority valve, indicated generally at 41, and shown, particularly, in FIG. 2. The priority valve has a valve member 42 urged against a valve seat 43 by a spring 44 which is of relatively light force up to certain design pressures to close off the branch line 40. The branch line 40 downstream of the priority valve connects to a pair of auxiliary inlets 45 and 46 for the main engine fuel pump 10 and with the branch line having a relief valve 47 connected into the inlet line 24*b* whereby there cannot be an excessive pressure buildup in the branch line 40.

The priority valve 41 is urged toward a closed position against the valve seat by the spring 44 and is reponsive to a pressure differential across the nozzle 32 to maintain a uniform rate of fluid flow through the nozzle. The pressure in the bypass line 16 acts on the valve member 42 in a direction tending to open the valve and in opposition to the spring while the pressure downstream of the nozzle and existing in the plenum 31 is applied to the opposite end of the valve member through sensing passages 50 and 51 in the casing 30. The priority valve functions to provide a constant rate of fuel flow through the nozzle. If the flow through the nozzle drops, the pressure downstream of the nozzle becomes more relative to that upstream of the nozzle and this causes the priority valve to move toward the valve seat to reduce the flow to the auxiliary inlets 45 and 46 and increase the flow through the nozzle. If the flow through the nozzle increases, pressure upstream relative to the pressure downstream increases, and the priority valve is opened more, to direct more fluid to the auxiliary inlets 45,46 and reduce the flow through the nozzle. The flow delivered by the fuel pump 10 to the fuel control 12 and the desired rate of flow through the nozzle 32 are set whereby the bypass line 16 always has sufficient fuel to provide proper flow to the nozzle, with some excess going to auxiliary inlets 45 and 46. As altitude increases, the engine utilizes less fuel and the fuel control 12 will cause increased fuel flow to the bypass line 16, with the priority valve 41 providing for an increased flow to the auxiliary inlets 45 and 46 to maintain the uniform flow to the boost stage. In FIG. 2, the branch line 40 is shown as including a position of the valve bore upstream of the valve seat 43 and an annular chamber surrounding the valve member 42 immediately downstream of the valve seat 43.

Figure 3:
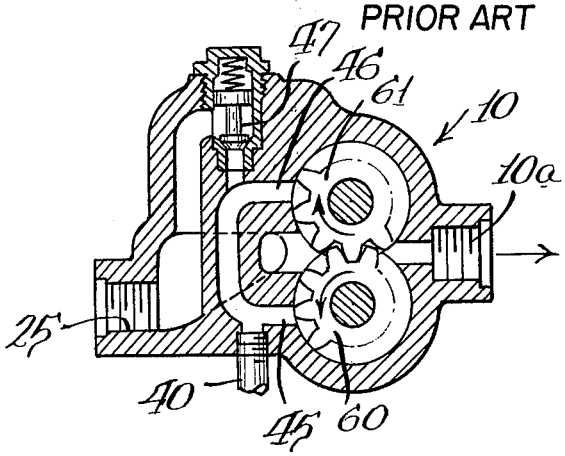
Fig. 3. PRIOR ART
FIG. 3 is a cross sectional view of a positive displacement pump in the form of rotary intermeshing gear pump of the type used in the schematic circuit of FIG. 1.

An example of the positive displacement pump 10 is shown in FIG. 3 and is taken from Prijatel U.S. Pat. No. 3,182,596. This pump has the rotary intermeshing gear units 60 and 61 rotating in the direction of the arrows, with the branch line 40 connected into the casing of the pump to supply the auxiliary inlets 45 and 46. The auxiliary inlets are out of communication with the inlet 25 by being spaced a sufficient arcuate distance which is at least one gear tooth space away from the inlet 25 to provide a seal so that there cannot be communication between the inlet 25 and the auxiliary inlets 45 and 46. With this construction, the auxiliary inlets supply fuel at a higher pressure than the inlet 25 to successive pumping chambers after initial filling from the inlet 25 to assure complete filling of the pumping chambers between gear teeth and to prevent formation of voids in the fuel which might otherwise occur because of vapor. With the fluid delivery system shown in FIGS. 1 to 3, it will be seen that fuel is only drawn from the tank 20 when the positive displacement pump 10 is operating. Additionally, there are only relatively low pressure suction feed lines between the tank 20 and positive displacement pump 10 whereby there is a reduced fire hazard as might be created when small arms fire penetrates the feed lines, as for example in a military helicopter.

With the uniform rate of fluid flow through the nozzle 32, the design of the boost stage ejector pump may be optimized for peak efficiency and, at the same time, excess flow in the by-pass line 16 may be directed to the auxiliary inlets 45 and 46 through the use of priority valve 41 to assure full pumping action of the fuel pump, even with vapor being present in the fuel.

Figure 4:
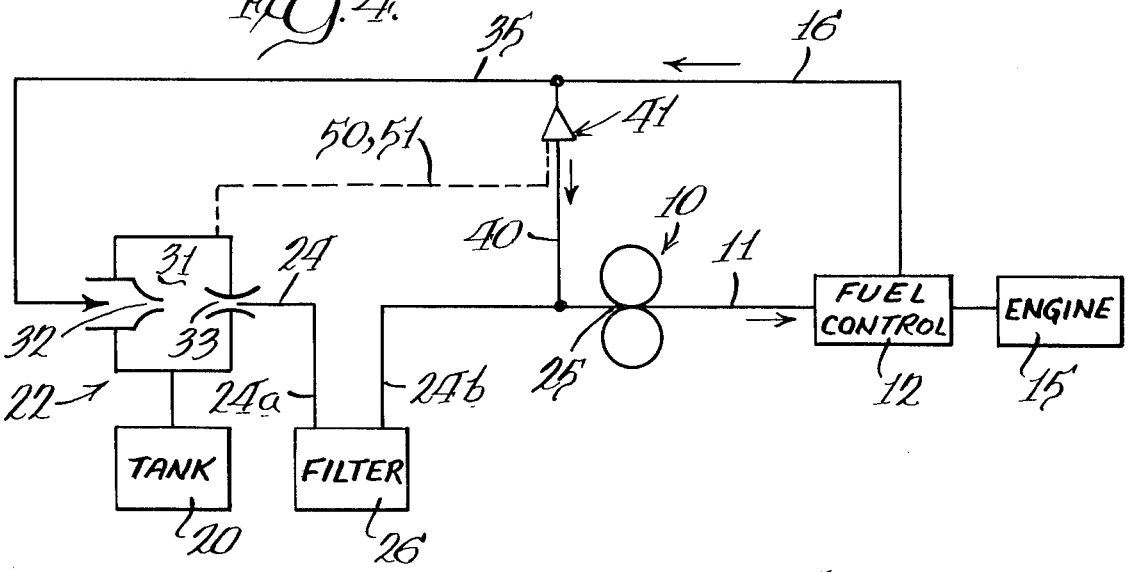
FIG. 4 is a schematic view of a second embodiment of the invention.

In the embodiment of FIG. 4, the same reference numerals have been applied as in the embodiment of FIGS. 1–3 with respect to structure common to the two embodiments.

In this embodiment, the branch line 40 downstream of the priority valve 41 connects directly into line **24*b* leading to the inlet 25 of the fuel pump 10, with this embodiment not having the auxiliary inlets to the positive displacement fuel pump and the relief valve associated therewith, since the branch line 40 discharges directly into the inlet line for the fuel pump. The priority valve 41 functions to maintain a uniform rate of flow through the bypass line to the nozzle 32, with excess flow being returned to the inlet 25 of the fuel pump 10.**

Figure 5:
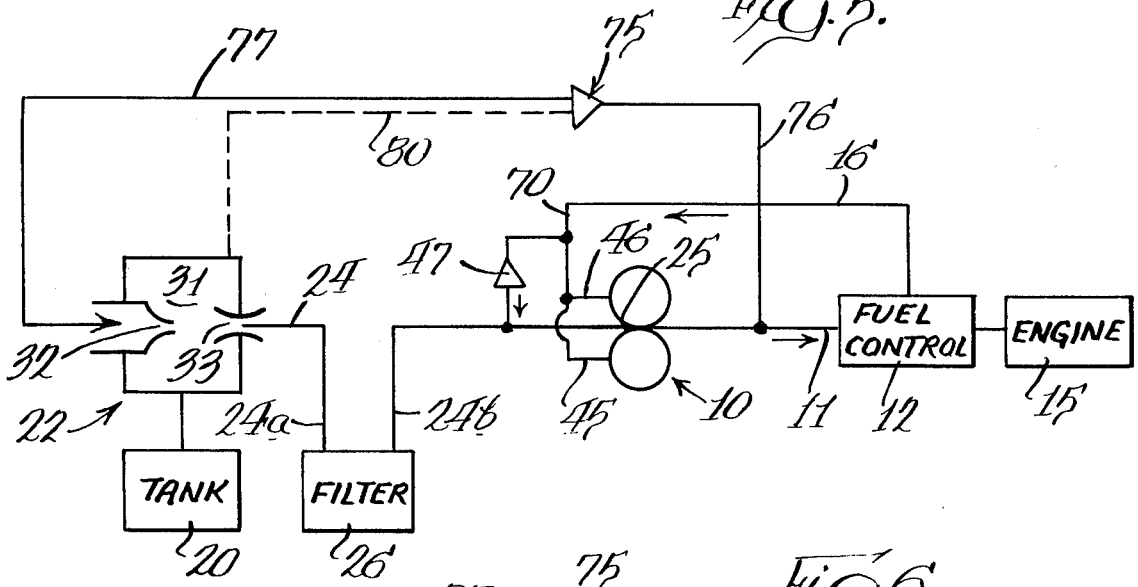
FIG. 5 is a schematic view of a third embodiment of the invention.

In the embodiments of FIG. 5, structure which is the same as that in the embodiment of FIGS. 1 to 3 has been given the same reference numeral.

In this embodiment, the bypass line 16, leading from the fuel control 12 is connected to the auxiliary inlets 45 and 46 for the fuel pump 10. Fuel is not derived from the bypass line in order to supply the nozzle 32. In this embodiment, the motive flow source control valve is a flow control valve 75 connected in a fuel line 76 extending between the discharge line 11 of the fuel pump and the nozzle 32, with a part 77 of the fuel line being downstream of the flow control valve 75. A sensing line 80 comparable to sensing lines 50 and 51 of the embodiment of FIGS. 1 to 3, directs the pressure existing in the plenum 31 to the flow contro control 75 whereby the flow control valve 75 operates in response to the pressure differential across the nozzle 32 to deliver a constant rate of fuel flow from the fuel in discharge line 11 to the nozzle 32. The non-utilized fuel directed by the fuel control 12 to the bypass line 16 is delivered to the auxiliary inlets 45 and 46 for assuring complete filling of the pumping chambers of the pump 10.

Figure 6:
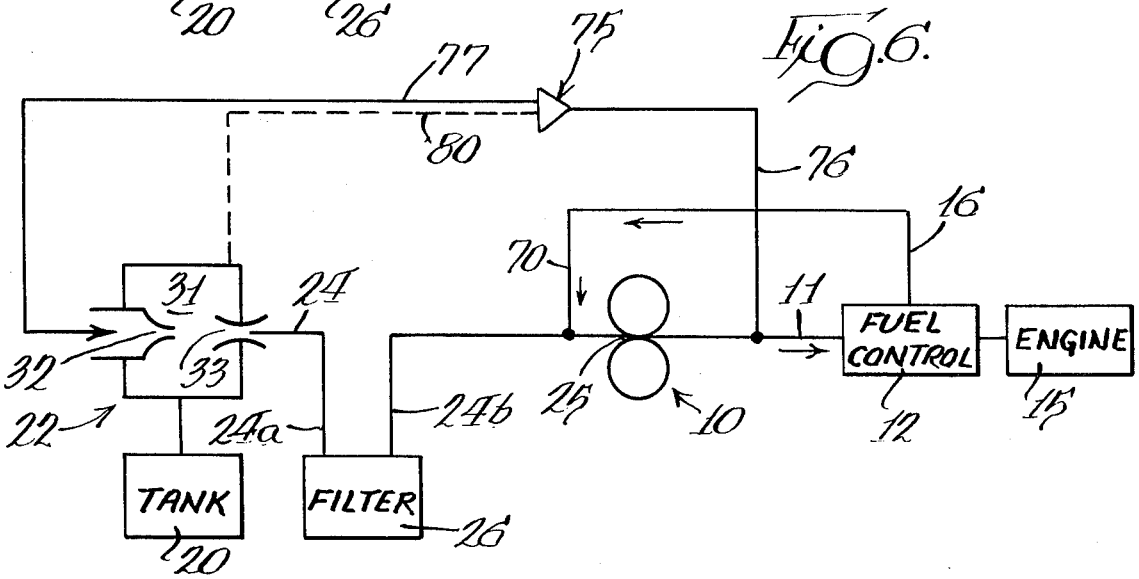
FIG. 6 is a schematic view of a fourth embodiment of the invention.

The embodiment of FIG. 6 is substantially the same as the embodiments of FIG. 5, with the flow control valve 75 positioned in the fuel line 76, which connects to the fuel pump discharge line 11. The fuel directed by the fuel control 12 to the bypass line 16 flows directly to the line **24*b* for flow into the inlet 25 of the fuel pump 10. The operation of the embodiment of FIG. 6 is the same as that of FIG. 5, except for non-utilized flow from the fuel control being returned to the inlet 25 of the fuel pump 10 and with the fuel pump not having the auxiliary inlets 45 and 46.**

With the embodiments disclosed herein, over-all performance of the fluid delivery system is optimized by the ability to use the best ejector stage design resulting from constant fuel flow through the nozzle thereof and with non-utilized fuel being returned to the main fuel pump.

Further advantages are derived, when required, through the flow of a portion of the nonutilized fuel pumped by the main fuel pump to auxiliary inlets of the fuel pump to further assure complete filling of the pumping chambers.

We claim:

1. A fluid delivery system for delivering fluid from a tank including a positive displacement pump having an outlet connected to a discharge line, fluid flow control means in said discharge line for varying the rate of fluid delivered by the system, an ejector pump upstream of the positive displacment pump for delivering fluid to an inlet of the latter pump from the tank and having a nozzle, means including a fluid line connected between said discharge line and said nozzle for directing a part of the fluid delivered by the positive displacement pump to said nozzle, and a valve separate from said fluid flow control means and having an inlet connected to said fluid line and operable to maintain a uniform rate of fluid flow through said fluid line to said nozzle, and said valve including means responsive to the rate of flow through said nozzle for control of valve operation to maintain said uniform rate of fluid flow.

2. A fluid delivery system as defined in claim 1 wherein said valve means is a flow control valve.

3. A fluid delivery system for delivering fluid from a tank including a positive displacement pump having an outlet connected to a discharge line, an ejector pump upstream of the positive displacement pump for delivering fluid to an inlet of the latter pump from the tank and having a nozzle, means for directing a part of the fluid delivered by the positive displacement pump to said nozzle, and a flow control valve for maintaining a uniform rate of fluid flow through said nozzle, said means for directing fluid to said nozzle including a bypass line for delivering non-utilized fluid supplied by the positive displacement to said nozzle, said flow control valve having an inlet connected to said bypass line and an outlet connected to the inlet side of the positive displacement pump, and means responsive to a pressure differential across said nozzle to control the position of the flow control valve to split the flow through said bypass line and maintain said uniform rate of fluid flow to said nozzle.

4. A fluid delivery system as defined in claim 3 wherein flow control valve outlet is connected to said inlet of the positive displacement pump.

5. A fluid delivery system as defined in claim 3 wherein said positive displacement pump has auxiliary inlets in addition to said inlet and which deliver fluid to pumping chambers of said last-mentioned pump without communicating with said inlet, and said flow control valve outlet being connected to said auxiliary inlets.

6. A fluid delivery system for delivering fluid from a tank including a positive displacement pump having an outlet connected to a discharge line, an ejector pump upstream of the positive displacement pump for delivering fluid to an inlet of the latter pump from the tank and having a nozzle, means for directing a part of the fluid delivered by the positive displacement pump to said nozzle, and a flow control valve for maintaining a uniform rate of fluid flow through said nozzle, said flow control valve having an inlet connected to said discharge line, said means for directing fluid to said nozzle includes a flow line connected between an outlet of said flow control valve and said nozzle, and means for positioning said flow control valve in response to a pressure differential across said nozzle to maintain a uniform rate of fluid flow through said nozzle.

7. A fluid delivery system as defined in claim 6 including a bypass line for returning nonutilized fluid supplied by the positive displacement pump back to the inlet side of the positive displacement pump.

8. A fluid delivery system as defined in claim 7 wherein said bypass line is connected to said pump inlet whereby said nonutilized fluid is delivered to said positive displacement pump inlet.

9. A fluid delivery system as defined in claim 7 wherein said positive displacement pump has auxiliary inlets in addition to said inlet and which deliver fluid to pumping chambers of said last-mentioned pump without communicating with said inlet, said bypass line being connected to said auxiliary inlets, and a relief valve connected to said bypass line.

10. A fluid delivery system and more particularly a system for delivery of fuel from a tank to an aircraft engine comprising, a fuel pump having an inlet and having a discharge line for delivery of fuel to an engine, a fuel control in said discharge line for controlling the volume of fuel supplied to the engine, a bypass line connected to said fuel control for receiving nonutilized fuel, an ejector boost pump having an inlet connected to the tank and an outlet operatively connected to said fuel pump inlet and having a plenum with a nozzle, means for directing part of the fuel pumped by said fuel pump to said nozzle to draw fuel into said inlet from the tank, and means including a flow control valve responsive to the pressure differential across said nozzle to maintain a constant rate of fuel flow through said nozzle.

11. A fluid delivery system as defined in claim 10 wherein said fuel pump has a pair of auxiliary inlets, said bypass line being connected to said nozzle to define said fuel directing means, a branch line connected to said bypass line and said auxiliary inlets and a relief valve therein, and said flow control valve being in said branch line to maintain a uniform rate of fuel flow to said nozzle with the excess fuel flowing to said auxiliary inlets.

12. A fluid delivery system as defined in claim 10 including a line extending from said discharge line to said nozzle for said supply of fuel thereto to define said fuel directing means, and said control valve being positioned in said last-mentioned line.

13. A fluid delivery system as defined in claim 12 wherein said bypass line is connected to said fuel pump inlet.

14. A fluid delivery system as defined in claim 12 wherein said fuel pump has a pair of auxiliary inlets and said bypass line is connected to said auxiliary inlets.

15. A fluid delivery system for delivery of fuel from a tank to an aircraft engine comprising, a positive displacement fuel pump having an inlet for supply of fuel to successive pumping chambers of the pump and a pair of auxiliary inlets for supply of fuel to pumping chambers without communicating with said inlet, a fuel control for an engine connected to an outlet of said pump, a bypass line connected to said fuel control for receiving nonutilized fuel, an ejector boost pump having a plenum with a nozzle defining an orifice and a mixing tube with said plenum connected to tank, a line connected from an outlet of the boost pump with interstage units therein and connected to the inlet of the positive displacement fuel pump, said nozzle being connected to said bypass line whereby nonutilized fuel flows through said nozzle, a branch line connected between said bypass line and said auxiliary inlets and having a relief valve therein, a priority valve in said branch line including a valve member urged to a closed position by a relatively light spring in a direction acting against the pressure of fuel in the bypass line and which, when open, permits fuel to flow to the auxiliary inlets at a rate dependent upon the degree of opening thereof, means for applying the pressure in said plenum against the valve member in opposition to the fuel pressure in the bypass line whereby the priority valve assumes a position responsive to the pressure differential across the nozzle orifice to establish a uniform rate of fuel flow to the nozzle with the excess fuel passing through the priority valve to the auxiliary inlets.

16. A fluid delivery system for delivery of fuel from a tank to an aircraft engine comprising, a positive displacement fuel pump having an inlet for supply of fuel to the pump, a fuel control for an engine connected to an outlet of said pump, a bypass line connected to said fuel control for receiving nonutilized fuel, an ejector boost pump having a plenum with a nozzle and a mixing tube with said plenum connected to tank, a line connected from an outlet of the boost pump with interstage units therein and connected to the inlet of the positive displacement fuel pump, said nozzle being connected to said bypass line whereby nonutilized fuel flows through said nozzle, a branch line connected between said bypass line and said fuel pump inlet, a priority valve in said branch line including a valve member urged to a closed position by a relatively light spring in a direction acting against the pressure of fuel in the bypass line and which, when open, permits fuel to flow to the fuel pump inlet at a rate dependent upon the degree of opening thereof, means for applying the pressure in said plenum against the valve member in opposition to the fuel pressure in the bypass line whereby the priority valve assumes a position responsive to the pressure differential across the nozzle to establish a uniform rate of fuel flow to the nozzle with the excess fuel passing through the priority valve to fuel pump inlet.

17. A fluid delivery system for delivery of fuel from a tank to an aircraft engine comprising, a positive displacement fuel pump having an inlet for supply of fuel to successive pumping chambers of the pump and a pair of auxiliary inlets for supply of fuel to pumping chambers without communicating with said inlet, a fuel control for an engine connected to an outlet of said pump, a bypass line connected to said fuel control for receiving nonutilized fuel, an ejector boost pump having a plenum with a nozzle and a mixing tube with said plenum connected to tank, a line connected from an outlet of the boost pump with interstage units therein and connected to the inlet of the positive displacement fuel pump, a branch line connected between said bypass line and said auxiliary inlets and having a relief valve therein, a fuel line between the fuel pump outlet and said nozzle, a flow control valve in said fuel line controlling the flow of fuel to said nozzle, means for applying the pressure in said plenum to said flow control valve in opposition to the fuel pressure in the fuel line whereby the flow control valve assumes a position responsive to the pressure differential across the nozzle to establish a uniform rate of fuel to the nozzle.

18. A fluid delivery system for delivery of fuel from a tank to an aircraft engine comprising, a positive displacement fuel pump having an inlet for supply of fuel to the pump, a fuel control for an engine connected to an outlet of said pump, a bypass line connected to said fuel control for receiving non-utilized fuel, an ejector boost pump having a plenum with a nozzle and a mixing tube with said plenum connected to tank, a line connected from an outlet of the boost pump with interstage units therein and connected to the inlet of the positive displacement fuel pump, a branch line connected between said bypass line and said pump inlet, a fuel line between the fuel pump outlet and said nozzle, a flow control valve in said fuel line controlling the flow of fuel to said nozzle, means for applying the pressure in said plenum to said flow control valve in opposition to the fuel pressure in the fuel line whereby the flow control valve assumes a position responsive to the pressure differential across the nozzle to establish a uniform rate of fuel flow to the nozzle.

* * * * *

UNITED STATES PATENT AND TRADEMARK OFFICE

CERTIFICATE OF CORRECTION

PATENT NO. : 4,033,706

DATED : July 5, 1977

INVENTOR(S) : John G. Schaefer and Terry L. Whitesel

It is certified that error appears in the above-identified patent and that said Letters Patent are hereby corrected as shown below:

In Claim 3, at Line 12 of Column 6 of the printed patent, after the word "displacement", insert --pump--.
In Claim 4, at Line 2 of Column 7 of the printed patent, after the word "wherein", insert --said--.
In Claim 12, at Line 2 of Column 8 of the printed patent, after the word "said", insert --flow--.
In Claim 17, at Line 21 of Column 9 of the printed patent, after the word "fuel", insert --flow--.

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*